US009694410B1

(12) United States Patent
Huang

(10) Patent No.: US 9,694,410 B1
(45) Date of Patent: Jul. 4, 2017

(54) PIPE EXPANDING DEVICE

(71) Applicant: YUNG CHI INDUSTRY CO., LTD., Taichung (TW)

(72) Inventor: Wu-Sheng Huang, Taichung (TW)

(73) Assignee: Yung Chi Industry Co., Ltd., Taichung (TW)

( * ) Notice: Subject to any disclaimer, the term of this patent is extended or adjusted under 35 U.S.C. 154(b) by 0 days.

(21) Appl. No.: 15/375,934

(22) Filed: Dec. 12, 2016

(51) Int. Cl.
*B21D 41/02* (2006.01)
*B21D 39/20* (2006.01)

(52) U.S. Cl.
CPC ..... *B21D 39/203* (2013.01); *B21D 41/02* (2013.01); *B21D 41/028* (2013.01)

(58) Field of Classification Search
CPC ..... B21D 39/203; B21D 41/028; B21D 41/02
USPC ..... 72/317
See application file for complete search history.

(56) References Cited

U.S. PATENT DOCUMENTS 3,052,279 A * 9/1962 Collin ..... B21D 41/021 72/317
3,194,040 A * 7/1965 Rasmussen ..... B21D 41/021 72/56
7,318,334 B2 * 1/2008 Carter ..... B21D 41/021 72/317
2016/0008866 A1 * 1/2016 Houle ..... B29C 57/04 72/370.08

* cited by examiner

*Primary Examiner* — David B Jones
(74) *Attorney, Agent, or Firm* — Wang Law Firm, Inc.

(57) ABSTRACT

A pipe expanding device includes: a clamping assembly including a pipe expanding end, an opposite connecting end, and a receiving space in communication with the pipe expanding end and the connecting end; a pipe expanding assembly movably disposed in the receiving space; a connecting member disposed at the connecting end; and an elastic member disposed in the receiving space and located between the pipe expanding assembly and the connecting member to push the pipe expanding assembly back toward the connecting end after the pipe expanding assembly is moved toward the pipe expanding end. The elastic member is hidden in the clamping assembly and capable of automatically pushing the pipe expanding assembly back to its original position. Therefore, the motion of the pipe expanding assembly won't be affected by the displacement of the pipe expanding tool, and the pipe expanding assembling therefore won't get bent or fall off.

6 Claims, 9 Drawing Sheets

PIPE EXPANDING DEVICE

BACKGROUND

Field of the Invention

The present invention relates to a pipe expanding device, and more particularly to a pipe expanding device capable of expanding the diameter of pipes.

Related Prior Art

Pipe expanding devices can find application in many fields, such as construction engineering, hydraulic and electric piping, air conditioning piping. As for the conventional pipe expanding device, the pipe expanding member of the pipe expanding tool is connected to an outer surface of the sleeve, then the pipe expanding member is pushed by a pushing member of a hydraulic device to expand the pipe fixed by a clamping member.

A conventional pipe expanding device is provided with a sleeve, a pipe expanding assembly and a hydraulic device. The sleeve includes a body and a connecting end on a lateral surface of the body. The body is provided with a receiving space, and an elongated slot is formed at each two lateral surface of the body. The hydraulic device includes a hydraulic cylinder connected to the connecting end of the sleeve. The hydraulic device is further provided with a handle and a pushing member. The pushing member is located in the connecting end, and the pipe expanding assembly is provided with a pipe expanding member and a positioning pin. The pipe expanding member is located in the receiving space of the body, and there is a connecting hole at two lateral surface of the pipe expanding member. The positioning pin is provided with a connecting portion and a pushing portion at two sides thereof. The connecting portions are connected in the connecting holes of the pipe expanding member, and the pushing portions protrude out of the elongated slots of the body.

The pipe expanding member is pushed into the pipe and causes deformation of the pipe, therefore, the pipe expanding member will not return to its original position when there is no external force pushing the pipe expanding member. The user has to push the pipe expanding member back to its original position by pushing the pushing portions of the positioning pin, in order for the next round of pipe expanding operation to proceed. Therefore, this conventional pipe expanding device has the disadvantage that the pipe expanding member is difficult to operate and unable to return to its original automatically.

Besides, the pipe expanding assembly is provided with the pipe expanding member and the elastic member. The pipe expanding member is disposed in the receiving space of the body, the elastic member is disposed in the receiving space and located toward the pipe expanding member. When in use, a threaded portion of the hydraulic device is screwed in the sleeve, the pushing member of the hydraulic device is disposed in the receiving space of the body. Pressing the handle of the hydraulic device can push the pushing member to move toward the pipe expanding tool, meanwhile, the pipe expanding member is also moved to compress the elastic member. When the pushing member of the hydraulic device returns to its original position, the elastic member will push the pipe expanding member back to its original position.

However, the elastic member moves together with the pipe expanding member (or the pipe expanding tool), therefore, when different pipes of different diameters are used, the elastic member is likely to fall off and has to be reassembled again, which is very troublesome.

The present invention has arisen to mitigate and/or obviate the afore-described disadvantages.

SUMMARY

One objective of the present invention is to provide a pipe expanding device, which is not only easy for assembly and disassembly, but also the elastic member is hidden in the clamping assembly instead of coming into direct contact with the pipe expanding tool. In addition to the automatic resetting function of automatically pushing the pipe expanding assembly back to its original position, the motion of the pipe expanding assembly will not be affected by the displacement of the pipe expanding tool, and therefore the pipe expanding assembly won't get bent or fall off.

To achieve the above objective, a pipe expanding device in accordance with the present invention comprises: a clamping assembly including a pipe expanding end, an opposite connecting end opposite to the pipe expanding end, and a receiving space in communication with the pipe expanding end and the connecting end; a pipe expanding assembly movably disposed in the receiving space; a connecting member disposed at the connecting end of the clamping assembly; and an elastic member disposed in the receiving space of the clamping assembly and located between the pipe expanding assembly and the connecting member to push the pipe expanding assembly back toward the connecting end after the pipe expanding assembly is moved toward the pipe expanding end.

Preferably, the clamping assembly detachably clamps a pipe expanding tool.

Preferably, the pipe expanding assembly includes a fixing member, a pipe expanding member, and a movable rod, the fixing member is fixed in the receiving space of the clamping assembly, the pipe expanding member is movably disposed in the receiving space and located between the pipe expanding end and the fixing member, the movable rod includes a first section for connecting the pipe expanding member, and a second section located between the connecting end and the fixing member, and the elastic member has two ends pressed between the fixing member and the second section of the movable rod.

Preferably, the elastic member is a compression spring.

Preferably, the movable rod further includes a shaft portion located between the first and second sections, and the elastic member is sleeved onto the shaft portion.

Preferably, the elastic member has two ends connected to the pipe expanding assembly and the connecting member.

Preferably, the elastic member is a tension spring.

Preferably, there are two said elastic members.

Preferably, the pipe expanding assembly includes a pipe expanding member and a movable rod, the pipe expanding member is movably disposed in the receiving space, the movable rod includes a first section connected to the pipe expanding member, and a second section located between the connecting end and the pipe expanding member, the elastic member has two ends connected to the pipe expanding member and the connecting member, respectively.

Preferably, one end of the connecting member is formed with an inner groove, the connecting member is connected to a drive unit, one end of the drive unit is provided with a protruding portion which is inserted in the inner groove and then rotates an angle, so as to provide a detachable connection between the connecting member and the drive unit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

Figure 1:
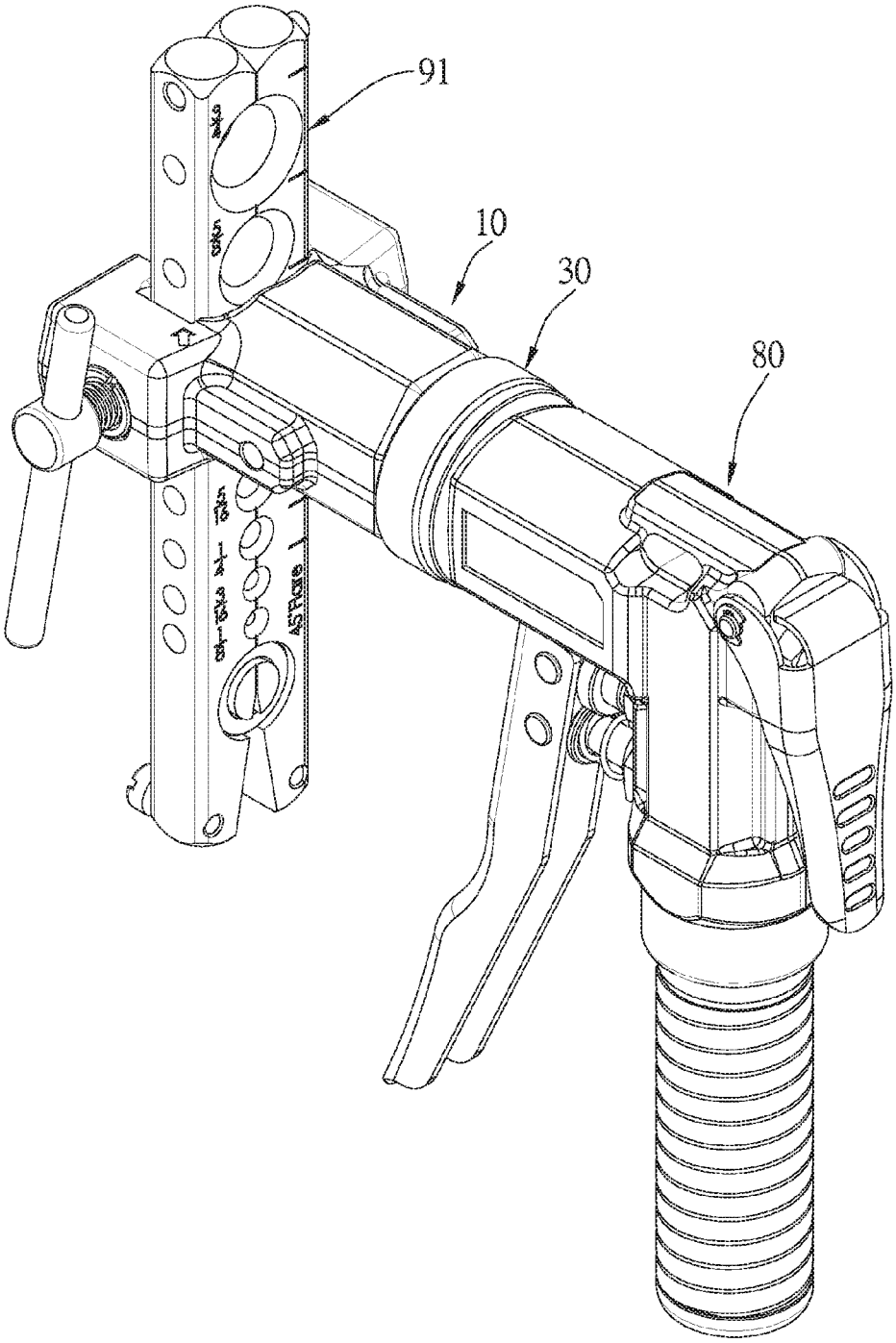
FIG. 1 is a perspective view of a pipe expanding device in accordance with a first embodiment of the present invention.
Figure 2:
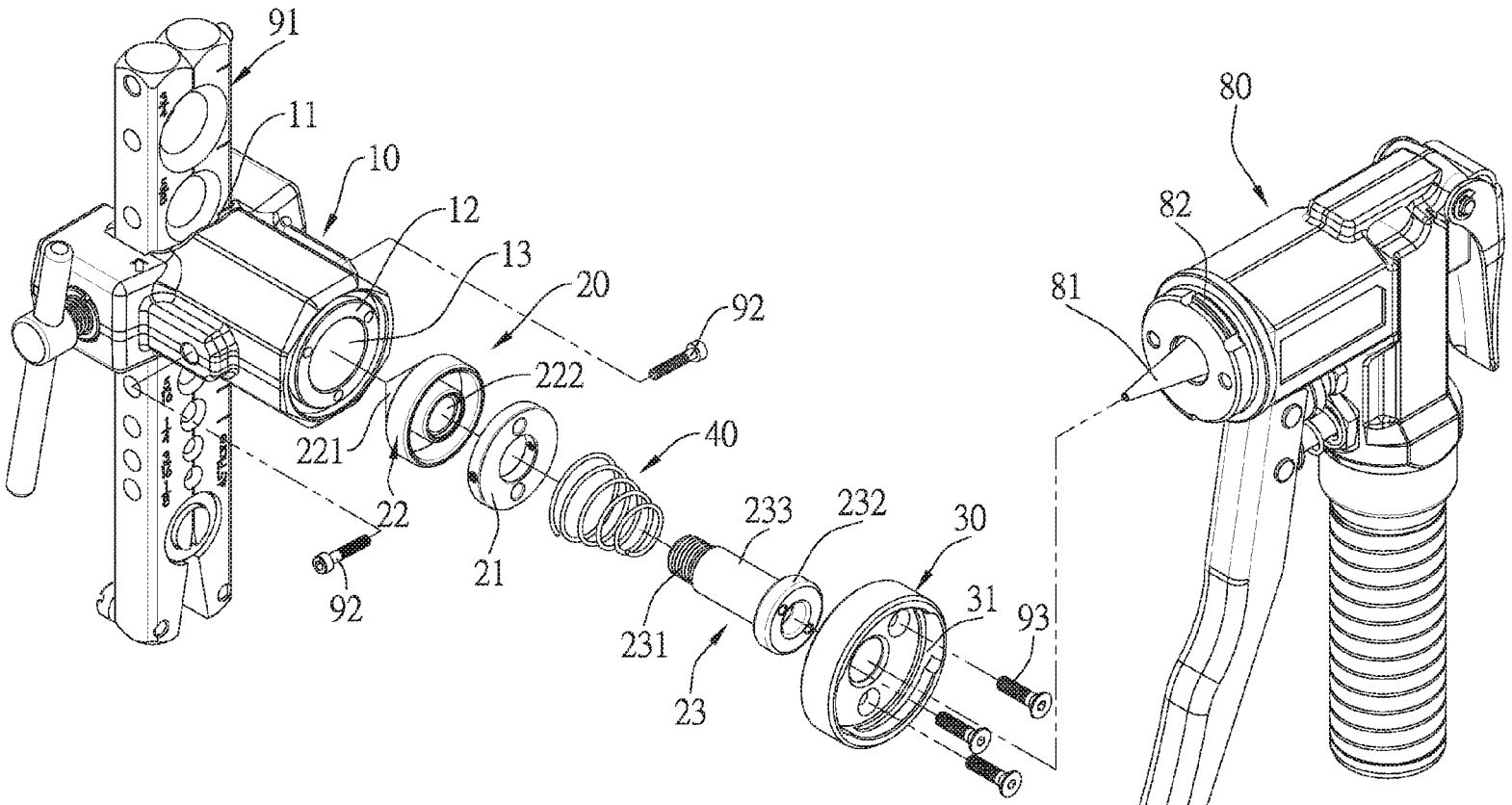
FIG. 2 is an exploded view of the first embodiment of the present invention, showing that the components of the pipe expanding tool and the drive unit are separated from one another.
Figure 3:
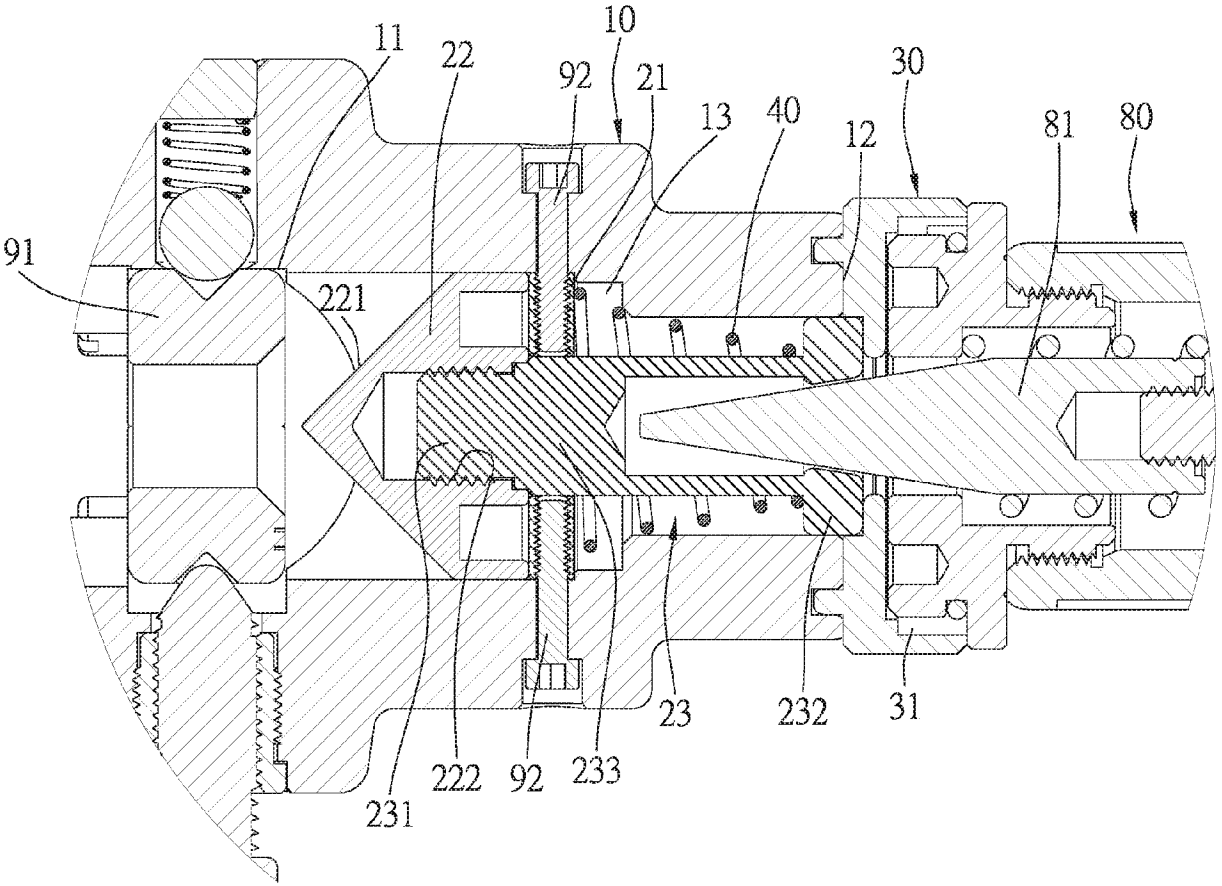
FIG. 3 is a cross sectional view of a part of the pipe expanding device in accordance with the first embodiment of the present invention.

The present invention will be clearer from the following description when viewed together with the accompanying drawings, which show, for purpose of illustrations only, the preferred embodiment in accordance with the present invention.

Referring to FIGS. 1-4, a pipe expanding device in accordance with the first embodiment of the present invention comprises: a clamping assembly 10, a pipe expanding assembly 20, a connecting member 30 and an elastic member 40.

The clamping assembly 10 includes a pipe expanding end 11, an opposite connecting end 12 opposite to the pipe expanding end 11, and a receiving space 13 in communication with the pipe expanding end 11 and the connecting end 12. In this embodiment, the clamping assembly 10 detachably clamps a pipe expanding tool 91.

The pipe expanding assembly 20 is movably disposed in the receiving space 13. In this embodiment, the pipe expanding assembly 20 includes a fixing member 21, a pipe expanding member 22, and a movable rod 23.

The fixing member 21 is fixed in the receiving space 13 of the clamping assembly 10 by screws 92.

The pipe expanding member 22 is movably disposed in the receiving space 13 and located between the pipe expanding end 11 and the fixing member 21. In this embodiment, the pipe expanding member 22 can be, but not limited to, conical shaped. The pipe expanding member 22 includes a conical top surface 221 for pipe expanding operation and an opposite inner threaded hole 222.

The movable rod 23 includes a first section 231 for connecting the pipe expanding member 22, a second section 232 located between the connecting end 12 and the fixing member 21, and a shaft portion 233 located between the first and second sections 231, 232. In this embodiment, the first section 231 is screwed in the inner threaded hole 222 of the pipe expanding member 22. This embodiment is not in any way intended to limit the invention, the movable rod 23 can also be integral with the pipe expanding member 22, and of course, the first section 231, the second section 232 and the shaft portion 233 can also be screwed to one another or integral with one another. Besides, the second section 232 can be a hollow structure for insertion of a drive head 81 of a drive unit 80. In this embodiment, the drive head 81 is conical shaped, and can be of any shape as long as it can push the second section 232.

The connecting member 30 is disposed at the connecting end 12 of the clamping assembly 10. In this embodiment, the connecting member 30 is fixed to the connecting end 12 of the clamping assembly 10 by screws 93, one end of the connecting member 30 is formed with an inner groove 31, and the connecting member 30 is connected to the drive unit 80. One end of the drive unit 80 is provided with a protruding portion 82 which is inserted in the inner groove 31 and then rotates an angle, so as to provide a detachable connection, namely a quick release connection between the connecting member 30 and the drive unit 80.

The elastic member 40 is disposed in the receiving space 13 of the clamping assembly 10 and located between the pipe expanding assembly 20 and the connecting member 30 to push the pipe expanding assembly 20 back toward the connecting end 12 after the pipe expanding assembly 20 is moved toward the pipe expanding end 11. In this embodiment, the elastic member 40 is a compression spring sleeved onto the shaft portion 233 and has two ends pressed between the fixing member 21 and the second section 232 of the movable rod 23.

What mentioned above are the structural relations of the main components of the first embodiment, and for the operation and function of the present invention, reference should be made to the following description.

Figure 4:
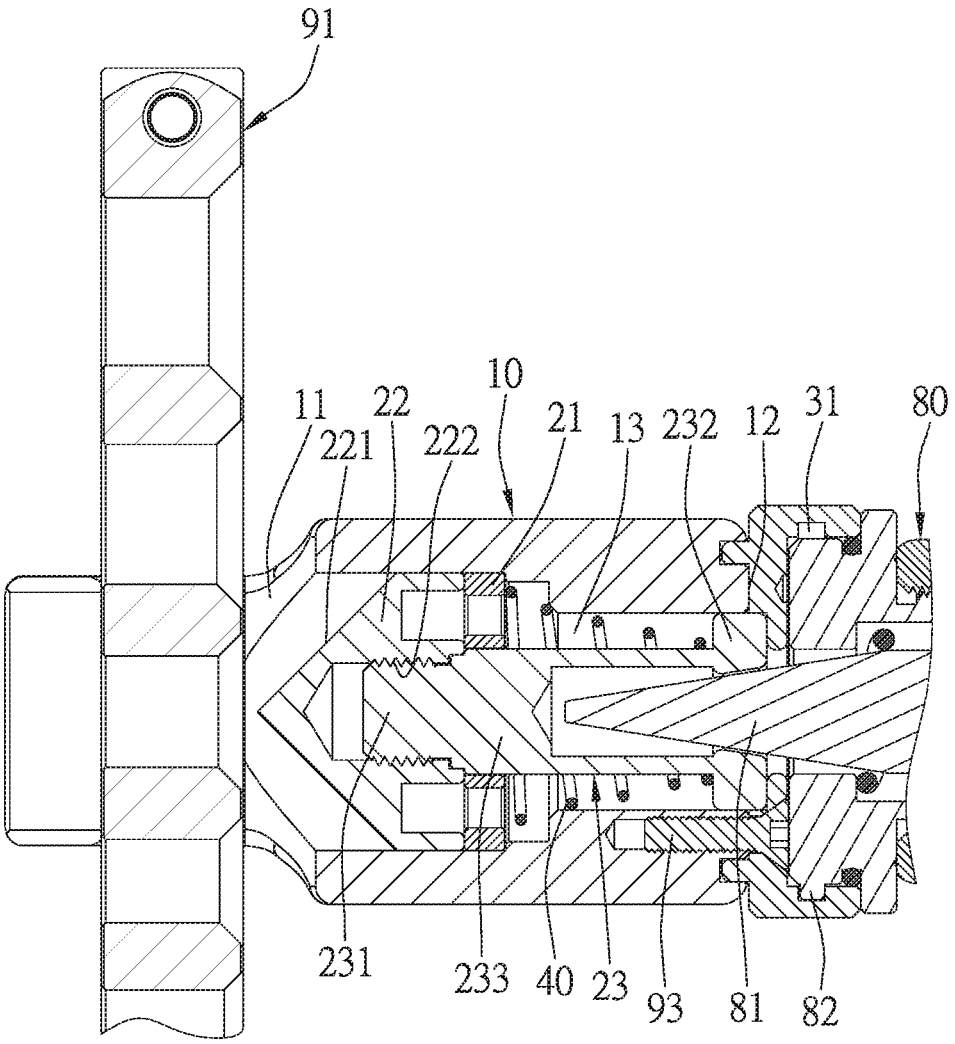
FIG. 4 is another cross sectional view of a part of the pipe expanding device in accordance with the first embodiment of the present invention.
Figure 5:
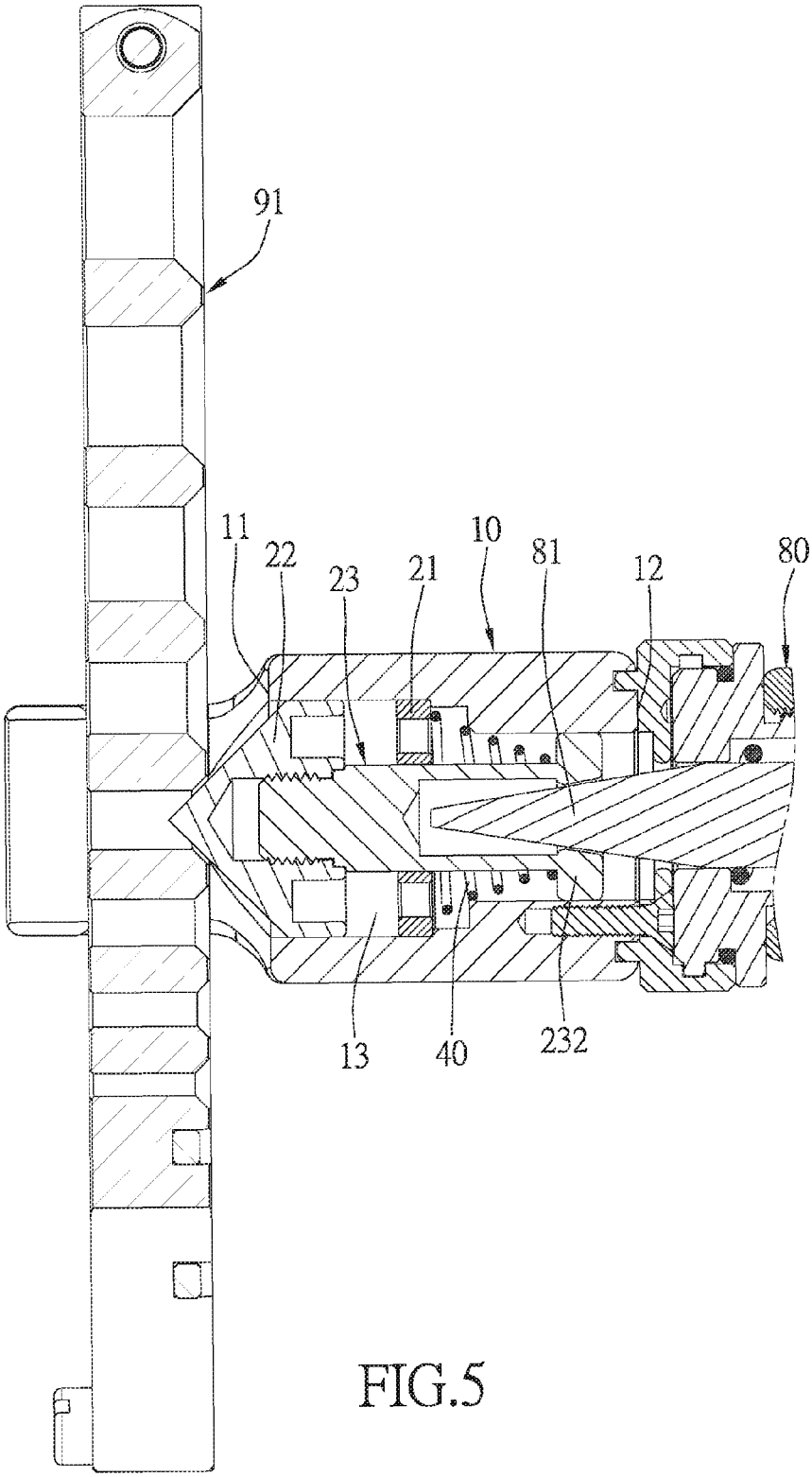
FIG. 5 is a cross sectional view of the pipe expanding device in accordance with the first embodiment of the present invention, showing that the pipe expanding assembly is moving toward the pipe expanding end of the clamping assembly.

As shown in FIGS. 4 and 5, when the drive head 81 of the drive unit 80 drives the movable rod 23 to move toward the pipe expanding end 11 of the clamping assembly 10, the pipe expanding member 22 also moves simultaneously toward the pipe expanding end 11 of the clamping assembly 10 to perform pipe expanding operation. At this moment, since the fixing member 21 is fixed in the receiving space 13 of the clamping assembly 10, the elastic member 40 is also hidden in the receiving space 13 of the clamping assembly 10 and has two ends pressed between the fixing member 21 and the second section 232 of the movable rod 23. Therefore, the elastic member 40 will accumulate an elastic force, when the drive head 81 of the drive unit 80 returns to its original position, the elastic member 40 will release the accumulated elastic force to push the pipe expanding member 22 and the movable rod 23 toward the connecting end 12 of the clamping assembly 10, achieving the purpose of automatic resetting.

Hence, the present invention is easy for assembly and disassembly, and the elastic member 40 is hidden in the clamping assembly 10 instead of coming into direct contact with the pipe expanding tool 91. In addition to the automatic resetting function of automatically pushing the pipe expanding assembly 20 back to its original position, the motion of the pipe expanding assembly 20 will not be affected by the displacement of the pipe expanding tool 91, and therefore won't get bent or fall off.

Figure 6:
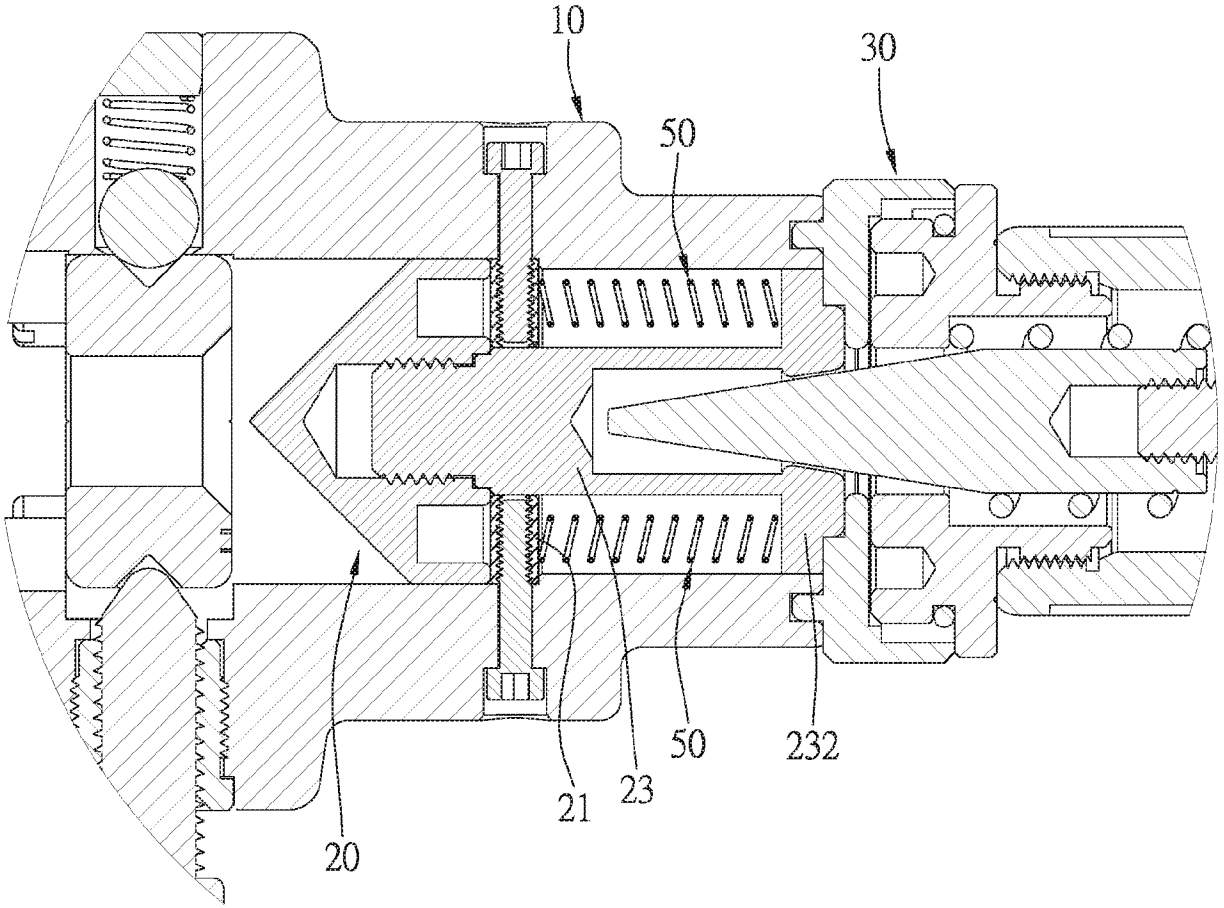
FIG. 6 is a cross sectional view of a pipe expanding device in accordance with a second embodiment of the present invention.

As shown in FIG. 6, a pipe expanding device in accordance with the second embodiment of the present invention is similar to the first embodiment, except that:

There are two elastic members 40, the two elastic members 40 are compression springs and have two ends pushed between the fixing member 21 and the second section 232 of the movable rod 23. In this embodiment, the elastic members 40 are not sleeved onto the movable rod 23. The quantity of the elastic members 40 can also be 3, 4 and more.

Figure 7:
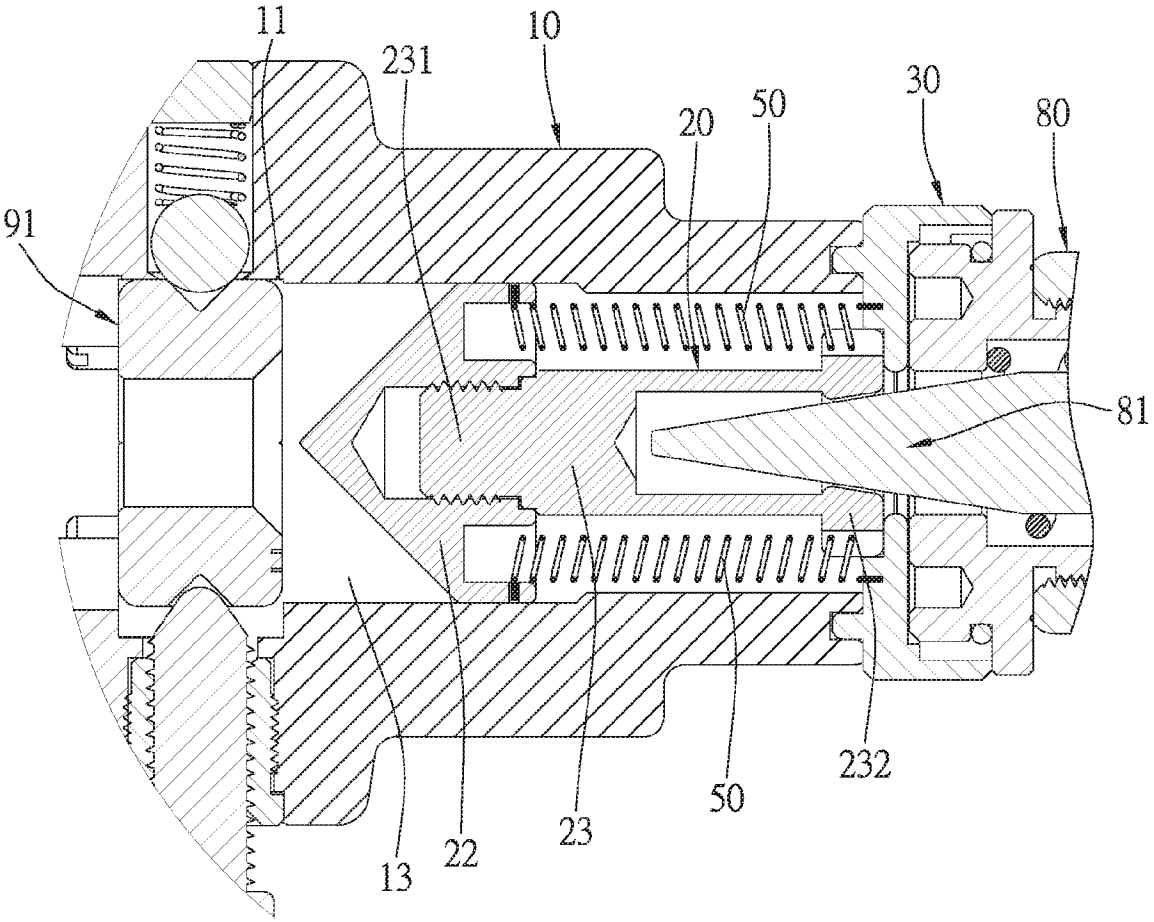
FIG. 7 is a cross sectional view of a pipe expanding device in accordance with a third embodiment of the present invention.
Figure 8:
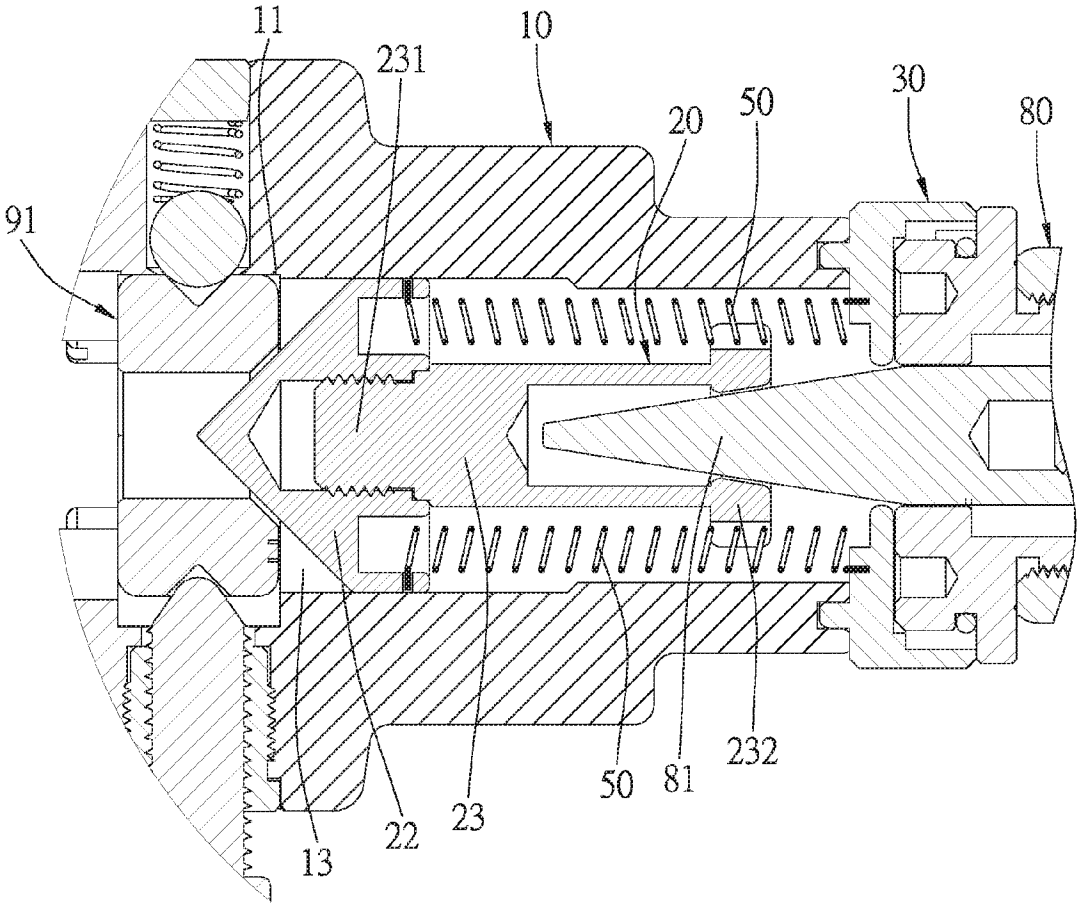
FIG. 8 is a cross sectional view of the pipe expanding device in accordance with the third embodiment of the present invention, showing that the pipe expanding assembly is moving toward the pipe expanding end of the clamping assembly.

As shown in FIGS. 7 and 8, a pipe expanding device in accordance with the third embodiment of the present invention is similar to the first embodiment, except that:

The pipe expanding assembly 20 includes a pipe expanding member 22 and a movable rod 23. The movable rod 23 includes a first section connected to the pipe expanding member 22, and a second section 232 located between the connecting end 12 and the pipe expanding member 22.

Figure 9:
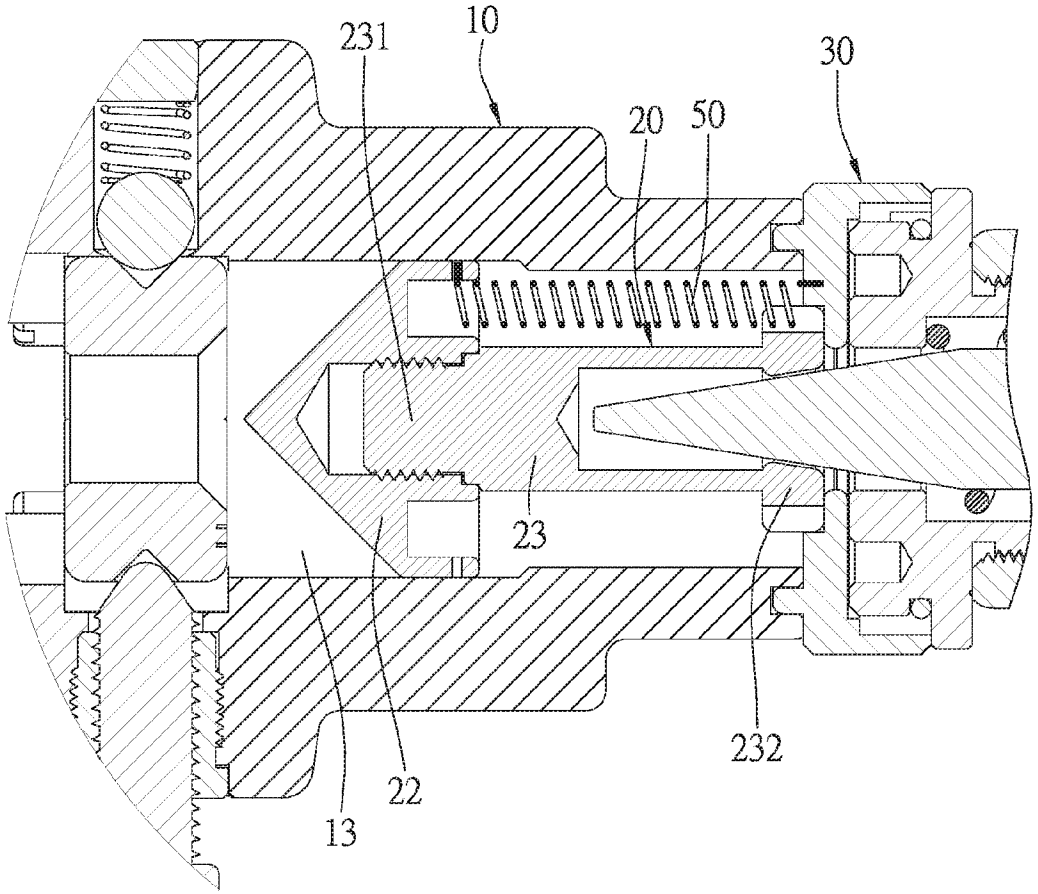
FIG. 9 is a cross sectional view of the pipe expanding device in accordance with the third embodiment of the present invention, showing that there is only one elastic member.

There two elastic members 50 in this embodiment. The elastic members 50 are tension springs disposed in the receiving space 13 of the clamping assembly 10, and each have two ends connected to the pipe expanding member 22 and the connecting member 30, respectively, by hooks or engaging means or by any other means. There can also be only one elastic member 50, as shown in FIG. 9, or, can also be three, four or more elastic members 50.

When the drive head 81 of the drive unit 80 drives the movable rod 23 to move toward the pipe expanding end 11 of the clamping assembly 10, the pipe expanding member 22 also moves simultaneously toward the pipe expanding end 11 of the clamping assembly 10 to perform pipe expanding operation. At this moment, since the elastic members 50 are tension springs hidden in the receiving space 13 of the clamping assembly 10 and have two ends pressed between the pipe expanding member 22 and the connecting member 30, respectively. Therefore, the elastic member 50 will accumulate an elastic force, when the drive head 81 of the drive unit 80 returns to its original position, the elastic member 50 will release the accumulated elastic force to push the pipe expanding member 22 and the movable rod 23 toward the connecting end 12 of the clamping assembly 10, thus achieving the purpose of automatic resetting.

In this third embodiment, the elastic members 50 are also hidden in the clamping assembly 10 instead of coming into direct contact with the pipe expanding tool 91. In addition to the automatic resetting function of automatically pushing the pipe expanding assembly 20 back to its original position, the motion of the pipe expanding assembly 20 will not be affected by the displacement of the pipe expanding tool 91, and therefore the pipe expanding assembly 20 won't get bent or fall off.

While we have shown and described various embodiments in accordance with the present invention, it is clear to those skilled in the art that further embodiments may be made without departing from the scope of the present invention.

What is claimed is:

1. A pipe expanding device, comprising:

a clamping assembly including a pipe expanding end, an opposite connecting end opposite to the pipe expanding end, and a receiving space in communication with the pipe expanding end and the connecting end;

a pipe expanding assembly movably disposed in the receiving space;

a connecting member disposed at the connecting end of the clamping assembly; and an elastic member disposed in the receiving space of the clamping assembly and located between the pipe expanding assembly and the connecting member to push the pipe expanding assembly back toward the connecting end after the pipe expanding assembly is moved toward the pipe expanding end;

wherein the pipe expanding assembly includes a fixing member, a pipe expanding member, and a movable rod, the fixing member is fixed in the receiving space of the clamping assembly, the pipe expanding member is movably disposed in the receiving space and located between the pipe expanding end and the fixing member, the movable rod includes a first section for connecting the pipe expanding member, and a second section located between the connecting end and the fixing member, and the elastic member has two ends pressed between the fixing member and the second section of the movable rod.

2. The pipe expanding device as claimed in claim 1, wherein the clamping assembly detachably clamps a pipe expanding tool.

3. The pipe expanding device as claimed in claim 1, wherein the elastic member is a compression spring.

4. The pipe expanding device as claimed in claim 1, wherein the movable rod further includes a shaft portion located between the first and second sections, and the elastic member is sleeved onto the shaft portion.

5. A pipe expanding device, comprising:

a clamping assembly including a pipe expanding end, an opposite connecting end opposite to the pipe expanding end, and a receiving space in communication with the pipe expanding end and the connecting end;

a pipe expanding assembly movably disposed in the receiving space;

a connecting member disposed at the connecting end of the clamping assembly; and an elastic member disposed in the receiving space of the clamping assembly and located between the pipe expanding assembly and the connecting member to push the pipe expanding assembly back toward the connecting end after the pipe expanding assembly is moved toward the pipe expanding end;

wherein the pipe expanding assembly includes a pipe expanding member and a movable rod, the pipe expanding member is movably disposed in the receiving space, the movable rod includes a first section connected to the pipe expanding member, and a second section located between the connecting end and the pipe expanding member, the elastic member has two ends connected to the pipe expanding member and the connecting member, respectively.

6. The pipe expanding device as claimed in claim 5, wherein one end of the connecting member is formed with an inner groove, the connecting member is connected to a drive unit, one end of the drive unit is provided with a protruding portion which is inserted in the inner groove and then rotates an angle, so as to provide a detachable connection between the connecting member and the drive unit.

* * * * *